US008844425B2

(12) United States Patent
Mueller

(10) Patent No.: US 8,844,425 B2
(45) Date of Patent: Sep. 30, 2014

(54) RECOIL APPARATUS FOR FIREARM

(75) Inventor: Stephen Mark Mueller, Appleton, WI (US)

(73) Assignee: Elite Tactical Advantage, Appleton, WI (US)

( * ) Notice: Subject to any disclaimer, the term of this patent is extended or adjusted under 35 U.S.C. 154(b) by 3 days.

(21) Appl. No.: 13/204,928

(22) Filed: Aug. 8, 2011

(65) Prior Publication Data

US 2013/0036900 A1 Feb. 14, 2013

(51) Int. Cl.
*F41A 5/00* (2006.01)

(52) U.S. Cl.
USPC ..... 89/191.01; 89/199; 42/1.06

(58) Field of Classification Search
USPC ..... 89/191.01, 191.02, 192, 198, 199; 42/1.06, 16, 17
See application file for complete search history.

(56) References Cited

U.S. PATENT DOCUMENTS

| | | | | |
|---|---|---|---|---|
| 659,507 | A | 10/1900 | Browning | |
| 689,283 | A | 12/1901 | Browning | |
| 730,870 | A | 6/1903 | Browning | |
| 2,465,196 | A * | 3/1949 | Browning | 89/177 |
| 2,494,889 | A * | 1/1950 | Maillard | 89/193 |
| 2,909,101 | A | 10/1959 | Hillberg | |
| 3,003,400 | A * | 10/1961 | Johnson | 89/14.05 |
| 3,848,511 | A | 11/1974 | Zanoni | |
| 3,869,961 | A * | 3/1975 | Kawamura | 89/191.02 |
| 4,003,292 | A * | 1/1977 | Christakos | 89/145 |
| 4,220,071 | A * | 9/1980 | Seiderman | 89/128 |
| 4,389,920 | A * | 6/1983 | Dufour, Sr. | 89/190 |
| 4,505,183 | A * | 3/1985 | Grehl | 89/191.02 |
| 4,901,623 | A * | 2/1990 | Lee | 89/193 |
| 5,870,846 | A * | 2/1999 | Ledford | 42/75.04 |
| 5,945,626 | A * | 8/1999 | Robbins | 89/193 |
| 5,959,234 | A | 9/1999 | Scaramucci et al. | |
| 7,467,581 | B2 * | 12/2008 | Botty | 89/193 |
| 2010/0236396 | A1 * | 9/2010 | Stone | 89/193 |
| 2012/0210864 | A1 * | 8/2012 | More | 89/43.01 |

* cited by examiner

*Primary Examiner* — Gabriel Klein
(74) *Attorney, Agent, or Firm* — Barnes & Thornburg LLP

(57) ABSTRACT

A recoil mechanism for an auto-loading firearm, having a gas-operated action bar assembly. One or more compression springs are used, mounted on associated retaining rods contained in a stationary orientation on the firearm. The springs are linked to the firearm's gas system at one end, and bear against stops affixed to ends of the spring retaining rods. The entire mechanism is contained within a forward grip mounted on the firearm, the grip optionally being provided with mounting rails.

13 Claims, 6 Drawing Sheets

38
42
40
36
34
28
18
22
20
26
24
30
32

RECOIL APPARATUS FOR FIREARM

BACKGROUND OF THE INVENTION

This invention relates to firearms, and in particular to a recoil mechanism for an auto-loading firearm having a gas-operated action bar assembly.

Gas-operated firearms usually including a receiver and a breach-bolt mechanism mounted for reciprocal movement to and from a battery position in the receiver. The bolt is linked to a piston or a piston and cylinder assembly which is automatically operated by a portion of pressurized gas which is developed upon the discharge of a round or cartridge, and bled from the gun barrel to the cylinder.

The pressurized gas that is bled from the barrel is converted to mechanical energy through the movement of the piston that is utilized to mechanically unlock the bolt mechanism after firing the firearm. It withdraws the bolt mechanism from the battery position, ejects the spent shell, and advances a fresh shell into position for loading into the breach chamber.

Simultaneously, an action spring (also known as a breach block return spring or buffer spring) coupled to the bolt mechanism is compressed. Subsequently, the action spring returns the bolt mechanism to the battery position, loading the fresh shell into the breach chamber. The mechanism including the action spring is commonly referred to as the "recoil mechanism" of the gun, for it recoils the bolt back into the firing position.

Typically the recoil mechanism is located in the butt stock of the firearm. On occasion, the recoil mechanism is located in the receiver, itself. Wherever located, the recoil mechanism is typically fixed in configuration, no matter what size round may be fired by the firearm.

U.S. Pat. Nos. 689,283; 659,507 and 730,870 are examples of typical auto-loading firearms in the form of a shotgun. In these patents, the recoil mechanism is located in the butt stock. The concepts of the firearms of these patents have been used for over 100 years, and are still commonly employed.

In prior art recoil mechanisms in the butt stock, the recoil mechanism slopes at an angle of 15° or more. When a cartridge is fired, the kinetic energy of the blast is directed rearwardly, actuating the breach block assembly. The inertia of the breach block assembly is forced into the angled recoil mechanism where it compresses the spring of the recoil mechanism. It is this motion and energy transfer that causes the barrel of the gun to be elevated at an angle much more pronounced than would be seen if the recoil was in essentially a straight line parallel to the barrel.

SUMMARY OF THE INVENTION

The invention is directed to a recoil mechanism for an auto-loading firearm having a gas-operated action bar assembly. A spring retaining rod is provided, configured to be mounted in a stationary orientation on the firearm. A clasp is slidingly mounted on the retaining rod, with the clasp being shaped to be secured to an action bar sleeve of the action bar assembly of the firearm. A compression spring is mounted on the retaining rod and bears against the clasp to bias the clasp in an extended orientation. A clamp is located at one end of the retaining rod, with the clamp being configured to be fixedly mounted in a stationary orientation on the firearm.

In accordance with the preferred form of the invention, the clasp includes a cradle which is shaped to be secured to the action bar sleeve. The clasp includes an internal bushing, the bushing being mounted on the retaining rod.

In the preferred form of the invention, two retaining rods are provided, one retaining rod being located on each side of the firearm when mounted thereon.

An end cap is secured to each retaining rod on the end opposite to that where the clamp is located. The compression spring on each retaining rod extends between the cap and the clasp.

In accordance with the preferred form of the invention, a pair of compression springs is mounted on each retaining rod. The compression springs of each pair are concentric, and are readily removable by removing the end cap or retaining rods.

To contain the retaining rods, the clasp, the compression springs and the clamp, a forward grip is provided. The forward grip may be railed for mounting of accessories on the firearm.

BRIEF DESCRIPTION OF THE DRAWINGS

The invention is described in greater detail in the following description of examples embodying the best mode of the invention, taken in conjunction with the drawing figures, in which.

DESCRIPTION OF EXAMPLES EMBODYING THE BEST MODE OF THE INVENTION

Figure 1:
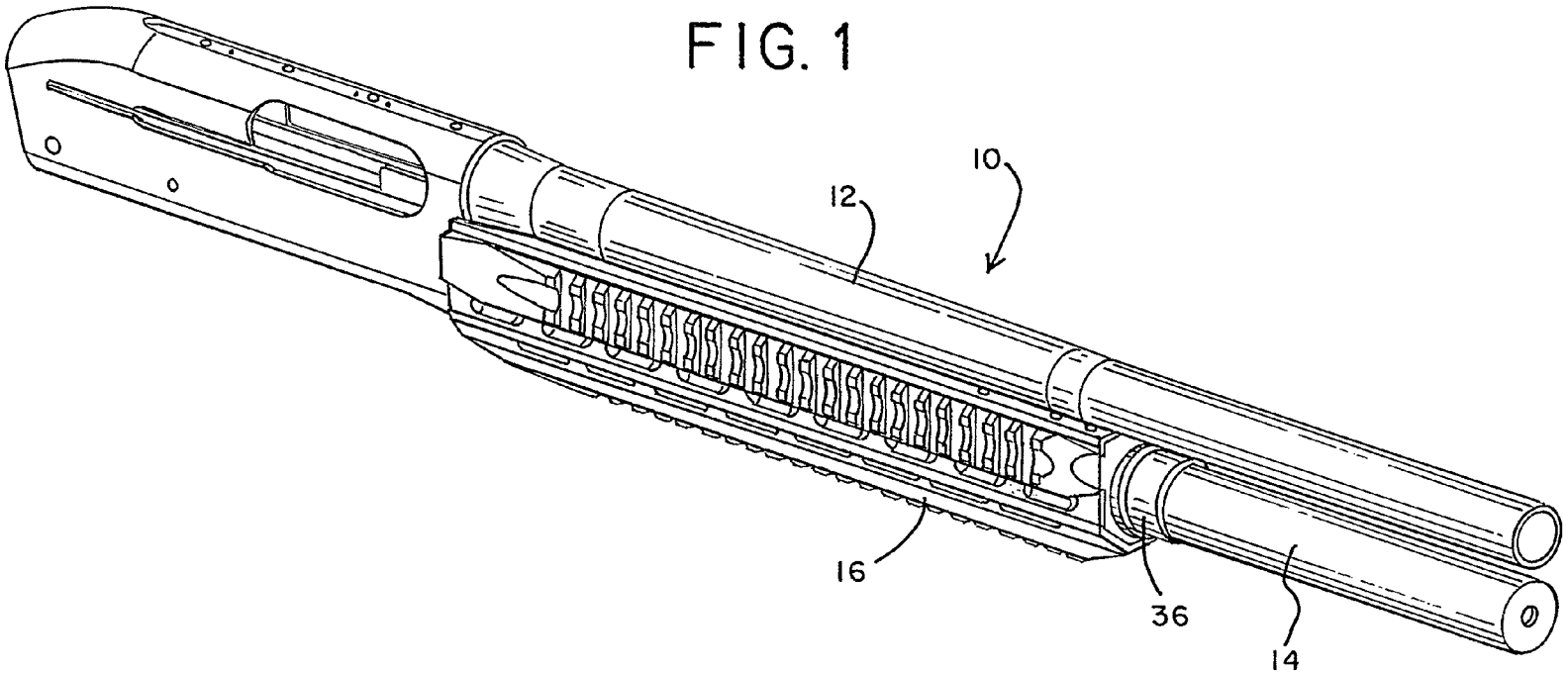
FIG. 1 is an isometric view of a portion of a firearm employing the recoil apparatus of the invention, installed beneath the forward grip.
Figure 3:
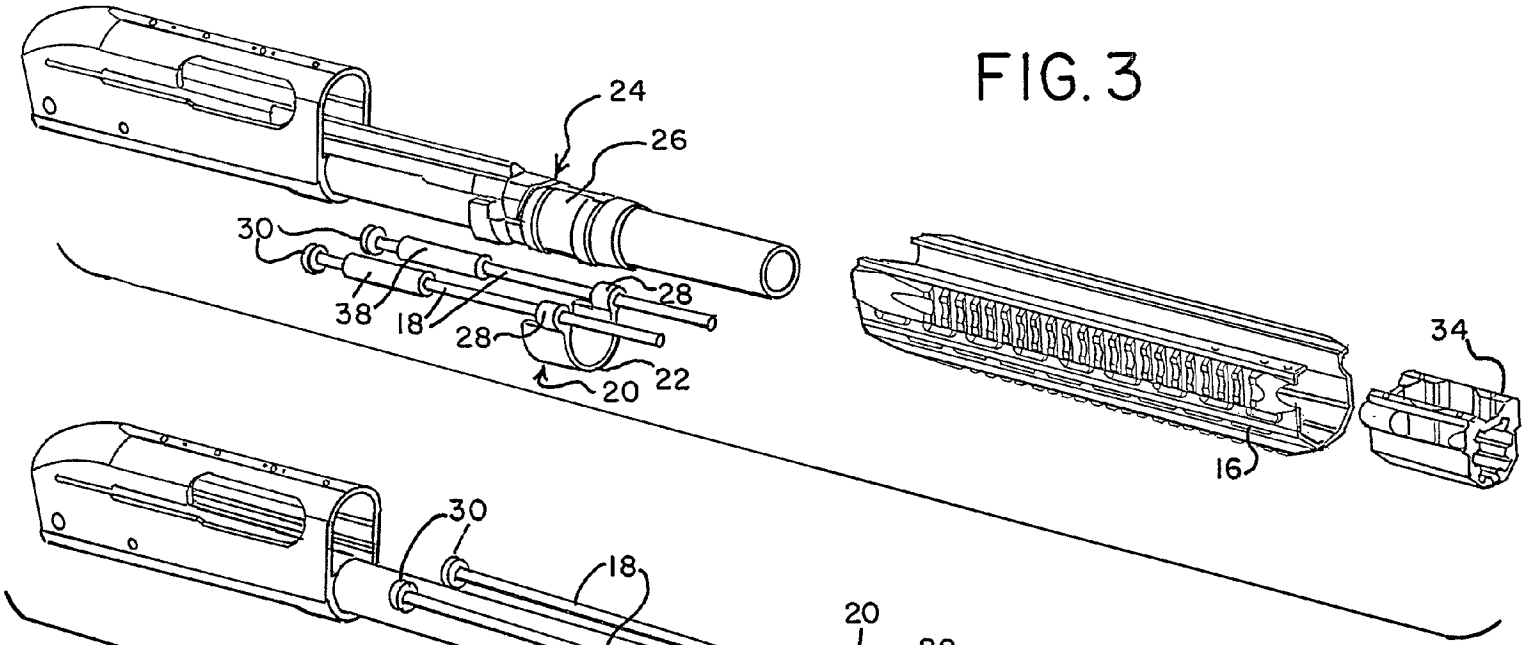
FIG. 3 is a further assembly view of the invention, shown in relation to the gas system of a gas-operated, auto-loading firearm, showing the recoil system beneath and in position to be attached to the gas system.
Figure 2:
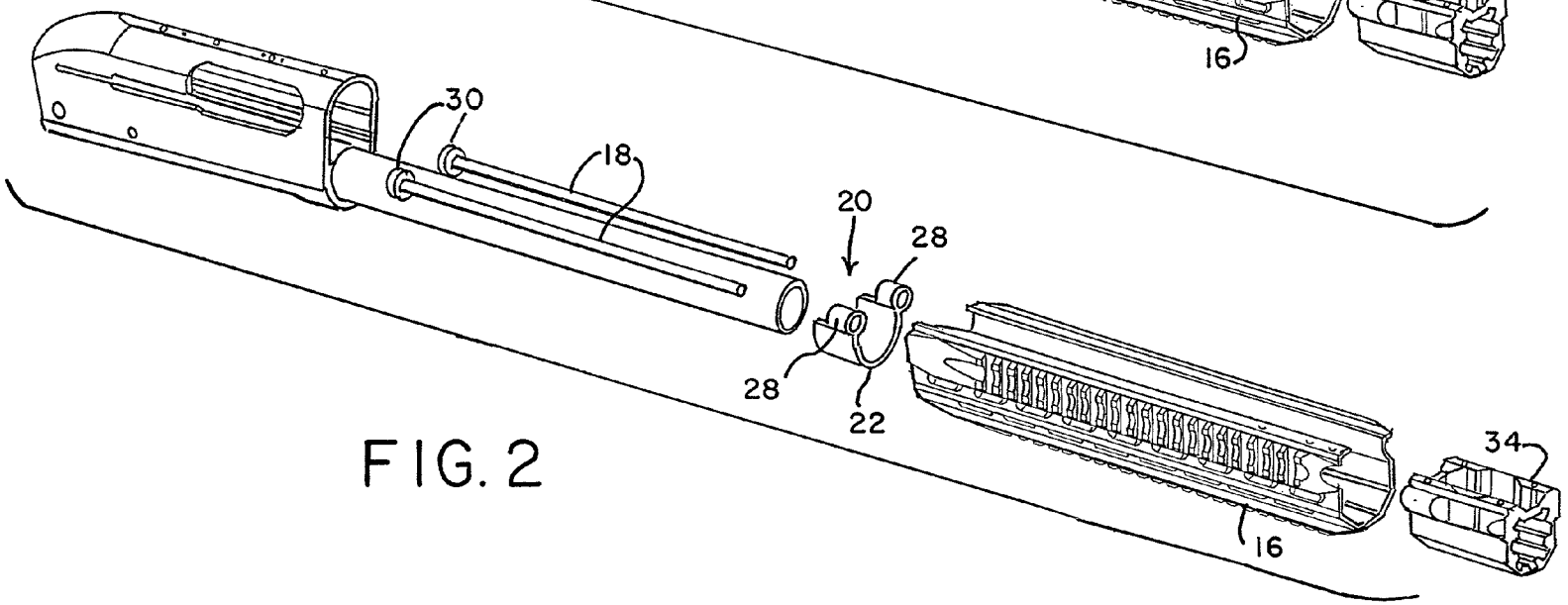
FIG. 2 is an assembly view of portions of the invention in relation to a portion of the gas system of a firearm, without the compression springs of the invention.

A firearm employing the recoil system according to the invention is shown generally at 10 in FIG. 1, and for simplicity of illustration, the firearm 10 is missing common elements unassociated with the invention, such as the butt stock, trigger and sighting apparatus. The firearm 10 illustrated is a schematic illustration of portions of the Remington Model 1100/11-87, which is gas-operated, auto-loading shotgun. Obviously, with appropriate modification, the invention can be employed within any gas-operated, auto-loading shotgun or other firearm, and illustration in relation to a Remington shotgun is simply for purposes of explanation.

The firearm 10 includes a single barrel 12 over a linear shell magazine or magazine tube 14. The elements of the invention are mounted beneath a housing in the form of a forward grip 16 fixed to the firearm 10.

The recoil mechanism according to the invention is shown in FIGS. 2 through 9. It comprises at least one, and preferably a pair of spring retaining rods 18 which slidingly carry a clasp 20 including a cradle 22 shaped to be secured to the action bar sleeve 24 of the firearm 10. The clasp 20 is the linking mechanism for attaching the invention to the gas system of the firearm 10, and as shown, the cradle 22 engages a corresponding annular indentation 26 in the action bar sleeve 24. The clasp is engaged by fitting it on the action bar sleeve 24, but can also be affixed by appropriate fasteners. It may be configured to engage whatever form the action bar sleeve may take.

The clasp 20 includes a pair of ears 28 that are slidingly mounted on the spring retaining rods 18. For ease of sliding, each of the ears can include an internal bushing that reduces the friction and wear of the rods 18. The bushings can be pressed in place and are wear parts that can be replaced, as needed. Preferably the bushings are made of PTFE impregnated nylon, but also can be brass, bronze or any similar material that is used to reduced wear and friction.

Each of the spring retaining rods 18 includes a stop in the form of an end cap 30. The end caps 30 are sufficiently robust to absorb spring force, as described below, and are suitably attached to the ends of the retaining rods 18, such as by pins 32 (FIG. 6).

Figure 9:
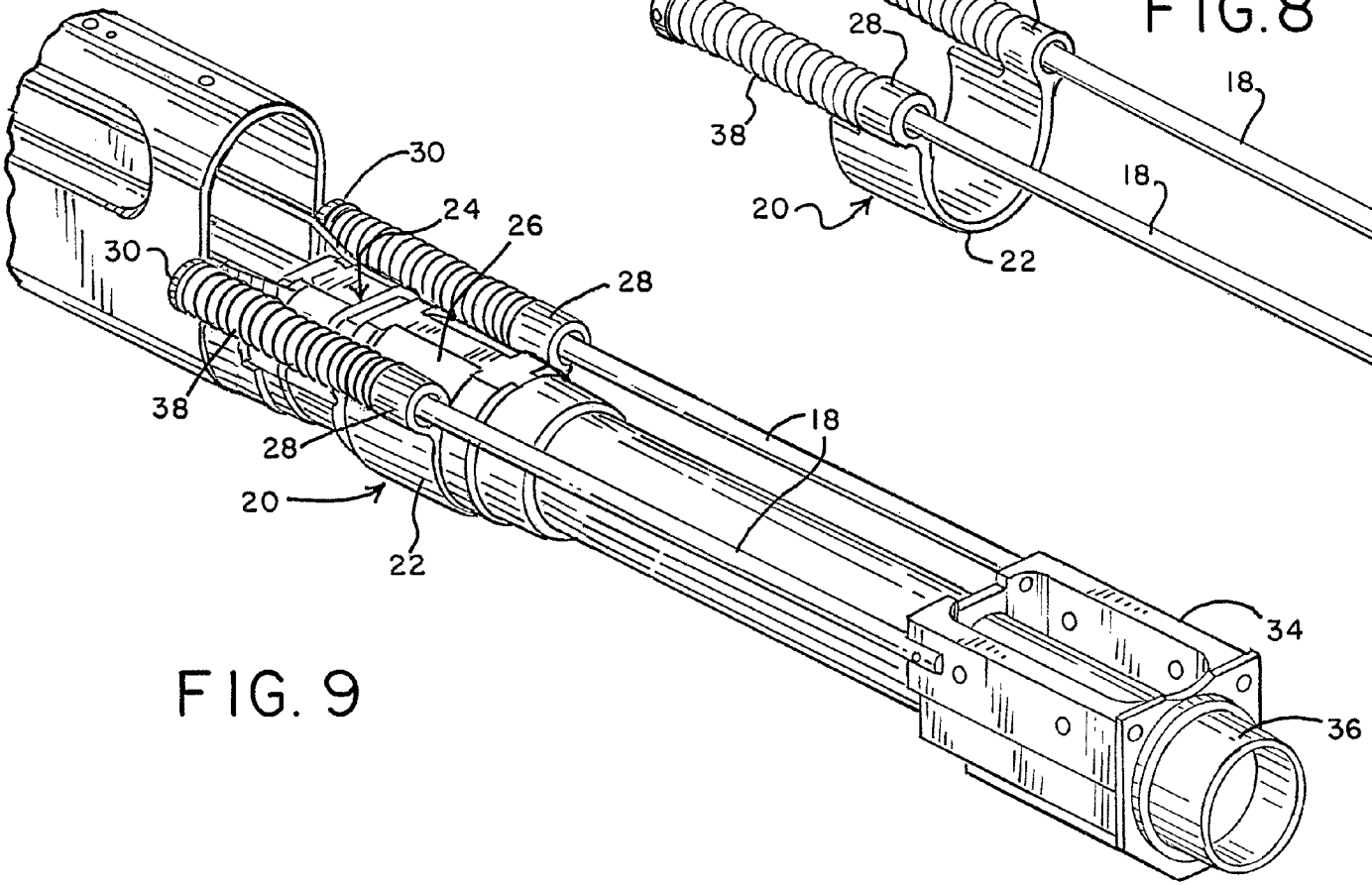
FIG. 9 is similar to FIG. 8, this time mounted on the gas system of a gas-operated, auto-loading firearm at the full apex of the recoil pulse.

The retaining rods 18 are held in place in a clamp 34. As shown in FIGS. 6, 7 and 9, the clamp 34 may include a forward collar 36 which engages over the shell magazine 14. The clamp 34, when mounted on the firearm 10, is fixedly mounted in a stationary orientation.

Compression springs 38 are mounted on each of the retaining rods 18. While, in most instances, the compression springs 38 are shown schematically as single springs or simply as tubular elements on the rods 18, preferably the compression springs 38 are each a nested pair of compression springs 40 and 42, as shown in FIG. 6A. Depending on the characteristics of the recoil mechanism of the invention, either nested or single springs can be used, so long as the required compression characteristics are met.

Figure 4:
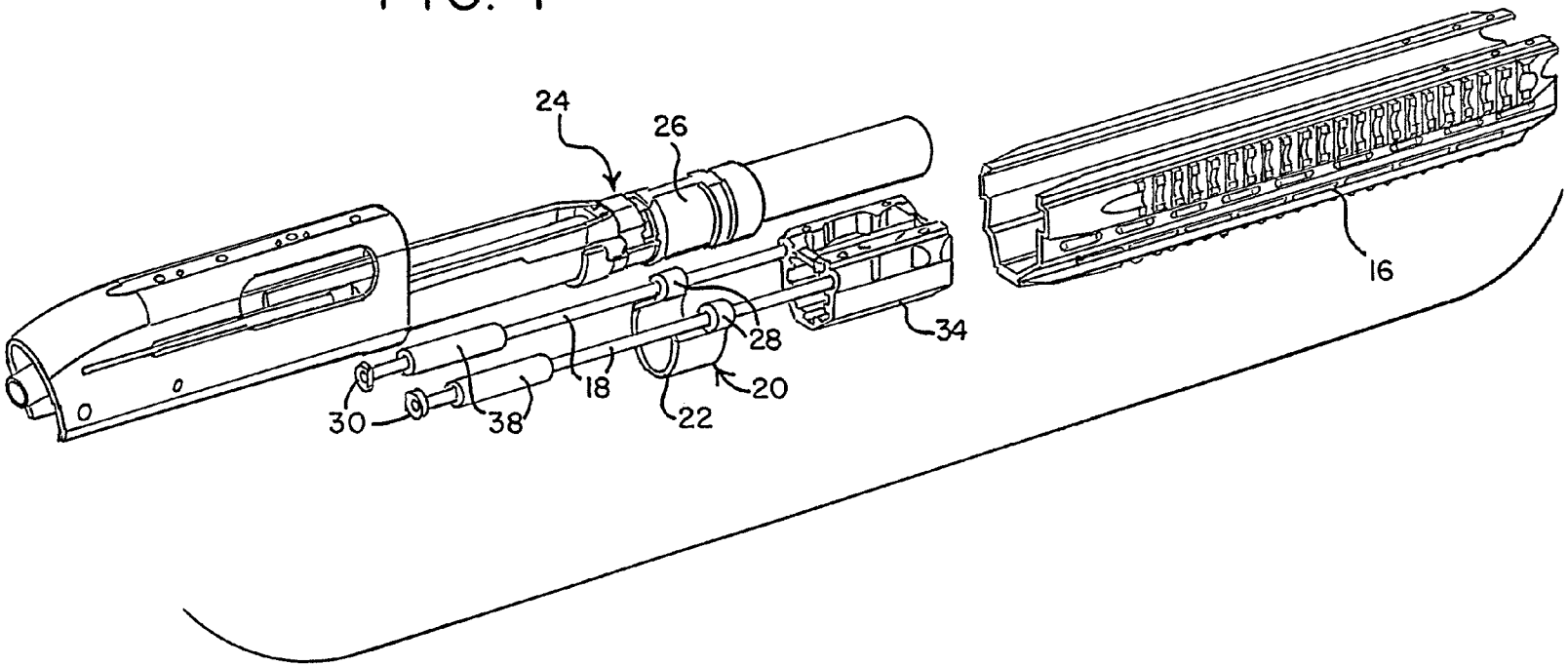
FIG. 4 is an isometric view similar to FIG. 3 but from the opposite orientation, showing all elements of the invention beneath the gas system and in position to be mounted.
Figure 5:
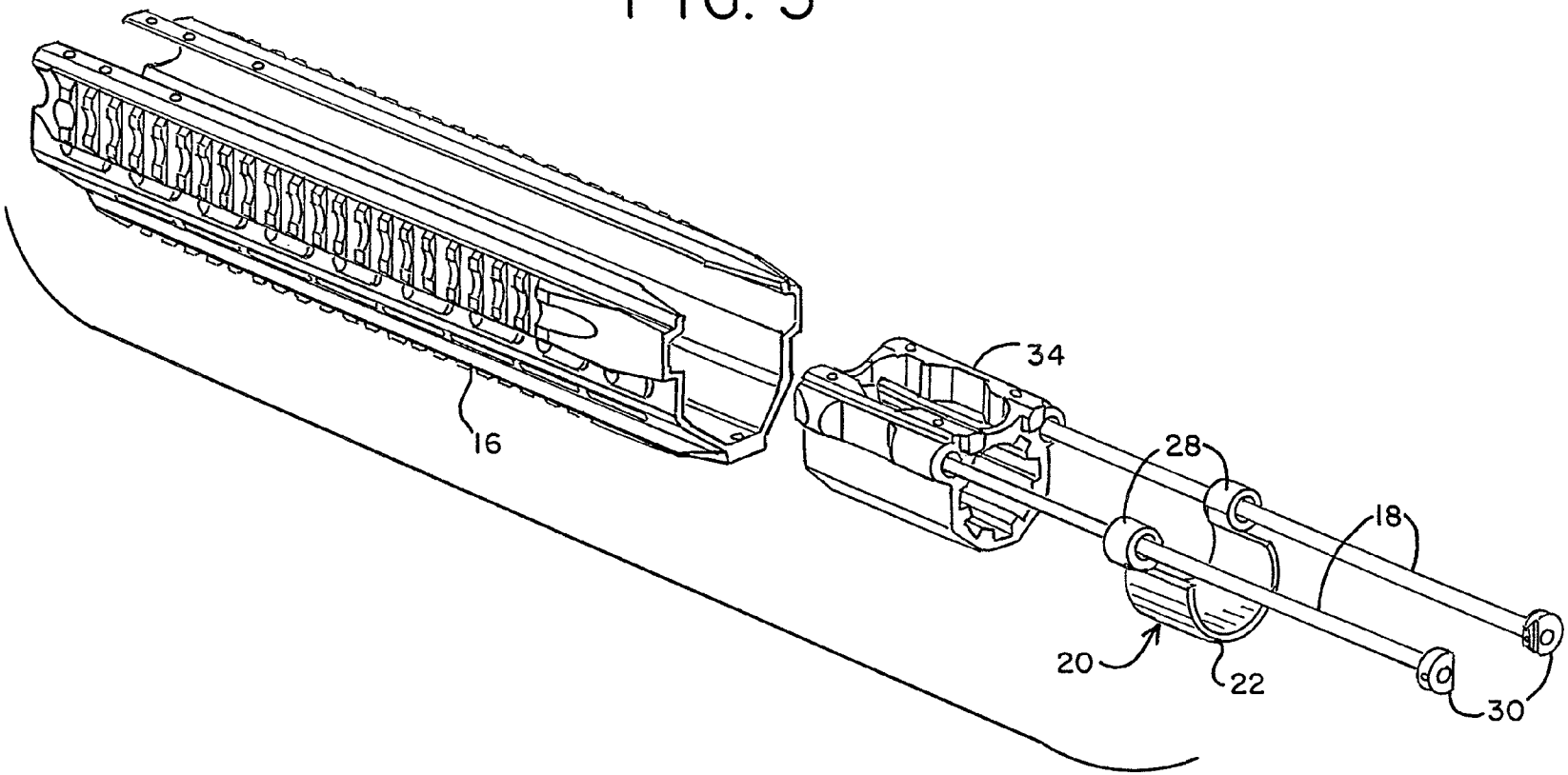
FIG. 5 is an isometric view of the elements of the recoil mechanism according to the invention, without the compression springs, in alignment with the forward grip for assembly.
Figures 6, 6A, 7:
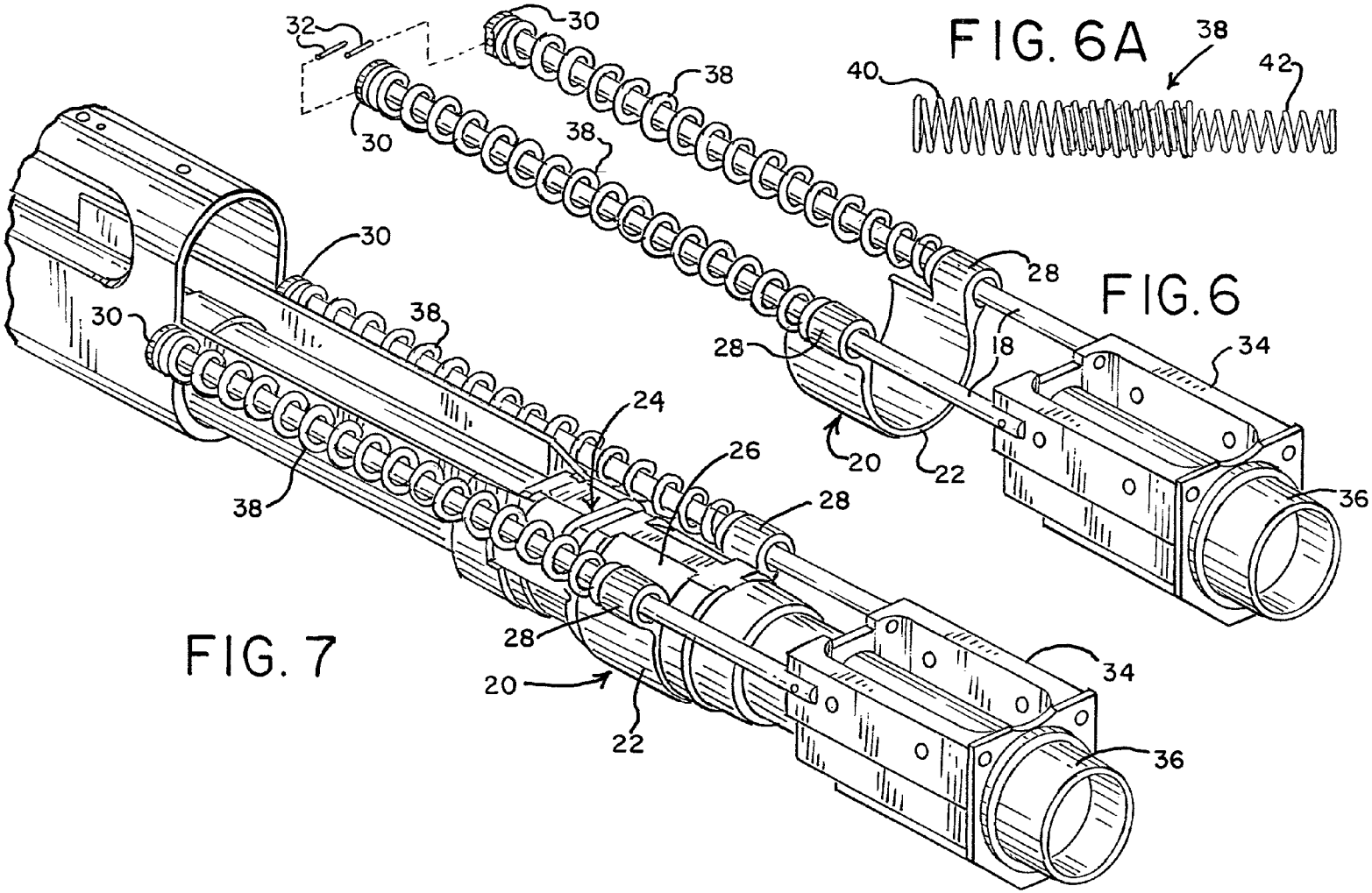
FIG. 6 illustrates the recoil mechanism, as fully assembled but without the firearm.
FIG. 6A illustrates a nested pair of compression springs according to the invention.
FIG. 7 illustrates the components of the invention, when mounted on the gas system of a gas operated, auto-loading firearm in the breach closed position.

FIG. 4 schematically illustrates an assembled recoil mechanism according to the invention as it is about to be installed on a firearm (with the springs 38 being shown very schematically) and FIG. 7 shows completion of that installation, but with the forward grip 16 not yet in place. FIG. 1 illustrates final assembly, with all elements of the recoil mechanism according to the invention shrouded beneath the forward grip 16.

The strength of the compression springs 38 is dependent upon the loads being fired by the firearm 10. Due to the modular nature of the recoil mechanism, it can be easily disassembled and the compression spring 38 removed and changed. It is the forward grip 16, when installed, that maintains all elements of the recoil mechanism in place although, obviously, the elements can be formed so that when they are together, as shown in FIGS. 4 and 6, they need not be help together by any other means.

Figure 8:
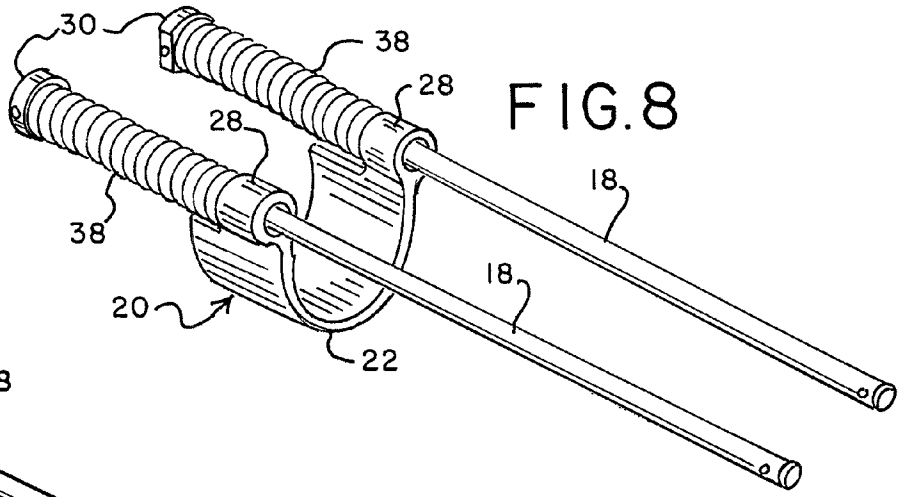
FIG. 8 illustrates the components of the invention, without the retaining rod clamp, in a breach open position at the full apex of a recoil pulse.

The extent of a recoil pulse is shown in FIGS. 7 and 8. In FIG. 7, the action bar sleeve 24 is shown in the breach closed position, at the furthest extent of travel of the action bar sleeve. In FIG. 8, although the action bar sleeve 24, clamp 34 and elements of the firearm 10 have been eliminated for simplicity, illustrated is the apex of a recoil pulse with maximum compression of the compression springs 38 and, if elements of the firearm 10 were illustrated, the firearm 10 being in a breach open position.

The invention is illustrated in relation to the installation on a particular Remington shotgun, as described above. It will be apparent to one skilled in the art that the invention could employ in relation to the gas system of any gas-operated, auto-loading firearm having a gas-operated action bar assembly. Various changes can be made to the invention without departing from the spirit thereof or scope of the following claims.

What is claimed is:

1. A recoil mechanism for an auto-loading firearm having a gas-operated action bar assembly communicating with a barrel of the firearm, comprising a. a spring retaining rod, said retaining rod being configured to be mounted in a stationary orientation on the firearm, b. a clasp slidingly mounted on said retaining rod, said clasp being shaped to be secured to an action bar sleeve of the action bar assembly of the firearm, said action bar sleeve being mounted for translation along said barrel, c. a compression spring mounted on said retaining rod and bearing against said clasp to bias said clasp in an extended orientation, and d. a clamp located at one end of said retaining rod, said clamp being configured to be fixedly mounted in a stationary orientation on the firearm, e. a second retaining rod, one retaining rod being located on each side of the firearm when mounted thereon, said clasp including a pair of internal bushings, one of said bushings being mounted on each said retaining rod.

2. The recoil mechanism according to claim 1, including an end cap on each retaining rod opposite said one end.

3. The recoil mechanism according to claim 2, including a compression spring mounted on each retaining rod, and in which said spring on each retaining rod extends between said cap and said clasp.

4. The recoil mechanism according to claim 1, including a pair of compression springs mounted on each retaining rod, said compression springs of each pair being concentric.

5. The recoil mechanism according to claim 1, including a forward grip formed to contain said retaining rods, said clasp, said compression spring and said clamp.

6. The recoil mechanism according to claim 5, in which said forward grip is railed.

7. A recoil mechanism for an auto-loading firearm having a gas-operated action bar assembly, comprising a. a pair of spaced spring retaining rods, b. a clasp slidingly mounted on said retaining rods, said clasp being shaped to be secured to an action bar sleeve of the action bar assembly of the firearm, c. a compression spring mounted on each retaining rod and bearing against said clasp to bias said clasp in an extended orientation toward one end of said rods, d. a clamp located at said one end of said retaining rod, and e. a housing formed to contain said retaining rods, said clasp, said compression springs and said clamp on said firearm, with said clamp and said retaining rods being fixedly mounted in a stationary orientation on the firearm.

8. The recoil mechanism according to claim 7, in which said housing comprise a forward grip.

9. The recoil mechanism according to claim 7, in which one retaining rod is located on each side of the firearm when mounted thereon.

10. The recoil mechanism according to claim 9, in which said clasp includes a pair of internal bushings, each bushing being mounted on one of said retaining rods.

11. The recoil mechanism according to claim 7, including an end cap on each retaining rod opposite said one end.

12. The recoil mechanism according to claim 11, in which said spring on each retaining rod extends between said cap and said clasp.

13. The recoil mechanism according to claim 7, including a pair of compression springs mounted on each retaining rod, said compression springs of each pair being concentric.

* * * * *